US008068065B1

(12) United States Patent
Struckman

(10) Patent No.: US 8,068,065 B1
(45) Date of Patent: Nov. 29, 2011

(54) CONCENTRIC RING LOG-PERIODIC SLOT DIRECTION FINDING ANTENNA

(75) Inventor: Keith A. Struckman, Grand Junction, CO (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 472 days.

(21) Appl. No.: 12/419,366

(22) Filed: Apr. 7, 2009

(51) Int. Cl.
*H01Q 11/00* (2006.01)
*H01Q 13/12* (2006.01)

(52) U.S. Cl. ..... 343/792.5; 343/769

(58) Field of Classification Search ..... 343/769, 343/792.5, 767, 770
See application file for complete search history.

(56) References Cited

U.S. PATENT DOCUMENTS 3,633,207 A * 1/1972 Ingerson et al. ..... 343/770
4,063,249 A 12/1977 Bergander et al.
4,208,660 A * 6/1980 McOwen, Jr. ..... 343/769
4,594,595 A 6/1986 Struckman
5,111,211 A * 5/1992 Dahlberg ..... 343/700 MS
5,164,738 A 11/1992 Walter et al.
5,194,876 A * 3/1993 Schnetzer et al. ..... 343/769
5,212,494 A 5/1993 Hofer et al.
5,714,961 A * 2/1998 Kot et al. ..... 343/769
7,233,285 B2 6/2007 Struckman

OTHER PUBLICATIONS

Norman Saucier & Keith Struckman, "Direction Finding Using Correlation Techniques", IEEE Antenna Propagation Society International Symposium, pp. 260-263, Jun. 1975.
R.H. Rumsey, "Frequency Independent Antennas", Academic Press, New York 1966, pp. 102-105.

* cited by examiner

*Primary Examiner* — Hoang V Nguyen
(74) *Attorney, Agent, or Firm* — Joseph E. Funk

(57) ABSTRACT

A concentric ring, log-periodic slot antenna used for direction finding is disclosed. There are a number of continuous, circular slots nested inside of each other. A cover over the slots cavities has excitation plates and conductors thereon. There are four excitation plates spaced ninety degrees apart over each circular slot, and the excitation plates of all slots in each ninety degree sector are electrically interconnected. A conductor from the interconnected excitation plates in each of the four sectors conducts received signals to a Butler matrix which processes the signals and provides Mode 0, Mode +1, Mode −1, and Mode Δ outputs. These Mode outputs are used to provide direction finding information for DF signal sorting, and they may be used to provide radio frequency voltages to other equipment to provide accurate DF (CIDF) and CIGL transmitter geo-location information.

20 Claims, 8 Drawing Sheets

$$|R(\phi^t)|^2 = \frac{\left|\sum_{1}^{na} U_n A_n^*(\phi^t)\right|^2}{\left(\sum_{1}^{na} |U_n|^2\right)\left(\sum_{1}^{na} |A_n(\phi^t)|^2\right)}$$

Where: $|R(\phi^t)|^2$ is the correlation squared $U_n$ are the voltage vectors recorded for a signal from an unknown direction $A_n(\phi^t)$ array calibration vectors for vertically polarized signals $na$ number of antennas in the array Relative linear gain at Elevation = 0 degrees versus degrees azimuth for Modes +1 & -1

Relative linear gain at Elevation = 0 degrees versus degrees azimuth for Modes 0 & Δ

CONCENTRIC RING LOG-PERIODIC SLOT DIRECTION FINDING ANTENNA

FIELD OF THE INVENTION

This invention relates to antennas for transmission and reception of electromagnetic radiation and, in particular, to circular log-periodic antennas.

BACKGROUND OF THE INVENTION

It is often required of direction-finder antenna systems that they be capable of covering the entire 360 degree azimuth range at an elevation near the horizon with two DF measurement receiver channels. In the past, most devices for achieving this purpose have been limited to a very narrow bandwidth. Consequently, when devices of this type were employed, a large number of them were needed if the frequency band to be monitored was wide.

An antenna whose characteristics are relatively frequency independent throughout a broad bandwidth is the log-periodic antenna. In such an antenna in the prior art, the individual elements are disposed along and perpendicular to an axis. The dimensions of the individual elements are proportional to the distance of the element from a reference point, or vertex, on the axis, and the distances between adjacent elements along the axis are also proportional to the distance from the vertex so that the ratio of the dimensions of one element to those of the previous adjacent element in the array is the same as the ratio for any two other adjacent elements.

Although this log-periodic structure results in a relatively frequency-independent response, radially orienting a number of such structures as sub-arrays of a composite array to achieve a 360 degree azimuth range has not in the past proved satisfactory. The interaction between the individual log-periodic sub-arrays has resulted in direction-finding errors. In addition, these log-periodic antennas have been relatively large which has limited their use on aircraft. Thus, it was previously necessary to employ either a narrow-band device to achieve the 360 degree range, to use extensive azimuth, elevation, and polarization antenna-response calibrations, or to limit the log-periodic structure to a single mechanically/azimuthally steered log-periodic antenna.

Although conventional log-periodic antennas have proven generally suitable for their intended uses, such conventional log-periodic antennas are generally physically too large to be utilized in applications wherein it is desirable that the antenna be as small as possible. Size is particularly important in small aircraft, spacecraft, and missiles. For example, the Unmanned Air Vehicle (UAV) is an unmanned military surveillance aircraft which must fly a considerable distance without refueling. Thus, it is desirable to minimize the weight of the aircraft, so as to increase the effective range thereof. Such weight constraints limit the physical size of any antenna to be utilized. The small size of the UAV also dictates the use of a small antenna and a limited number of RF measurement receivers.

It is known to form such an array of antenna elements in a flat, generally circular configuration so as to define a broadband antenna which requires minimal volume and minimizes the size of the antenna. One example of such a circular, log periodic, broadband antenna is disclosed in U.S. Pat. No. 4,594,595 issued on Jun. 10, 1986 to Keith Struckman and entitled "Circular Log-Periodic Direction—Finder Array".

Three other examples of circular log periodic antennas are provided in U.S. Pat. No. 4,063,249, issued on Dec. 13, 1997 to Bergander et al., and entitled "Small Broadband Antenna Having Polarization Sensitive Reflector System"; U.S. Pat. No. 5,164,738, issued on Nov. 17, 1992 to Walter et al., and entitled "Wideband Dual-Polarized Multimode Antenna"; and U.S. Pat. No. 5,212,494 issued on May 18, 1993 to Hoffer et al., and entitled "Compact Multi-Polarized Broadband Antenna".

Another problem with prior art log periodic antennas is as follows. Log periodic slots operate when the operational frequency is approximately $\lambda/2$. Therefore, if the log periodic slot array is designed where adjacent parts of the array are touching then the slot of a first part of the array must be spaced at $\lambda/2$ from the slot of an adjacent part of the array. This spacing dictates the minimum size of the DF antenna.

Thus, there is a need in the art to provide a broadband, log-periodic antenna assembly which is comparatively small in size and therefore does not contribute substantially to the weight of an airborne vehicle to which it is attached and is also suitable for use in very small vehicles. Further, there is a need for a log periodic antenna that is broadband, and that can achieve equal antenna gain in all directions at or near the horizon.

SUMMARY OF THE INVENTION

The previously described problems and needs of the prior art are satisfied by the present invention. A novel, compact, concentric ring log-periodic direction finding slot antenna design having a broadband omnidirectional frequency response is disclosed which permits the simultaneous use of the slots by adjacent log-periodic reception feeds. In addition, the antenna is very compact, light weight, and has equal antenna gain in all directions with equal signal phasing, and is suitable for use in small unmanned air vehicles and the like. When used for direction finding (DF) applications the novel antenna can provide DF capability over a complete azimuth window of 360 degrees and near the horizon while having uniform antenna gain in all directions using only two receiver channels.

The novel log-periodic direction finding slot antenna, includes a novel Butler matrix that provides Angle-of-Arrival (AOA) direction finding information that is used by a Correlation Interferometer Direction Finding (CIDF) process to quickly provide DF information, The AOA information can also be used by a Correlation Interferometer Geo-Location (CIGL) process that provides highly accurate geo-location information of transmitters. Such a CIGL process is taught in U.S. Pat. No. 7,233,285 issued Jun. 19, 2007 to Keith A. Struckman, and entitled "Correlation Interferometer Geolocation".

The novel log-periodic direction finding slot antenna has a plurality of channels in the form of continuous circles that are concentrically arranged. The preferred application of the novel log-periodic slot antenna is a small airborne antenna for direction finding over a complete azimuth window of 360 degrees at or near the horizon using only two receiver channels.

Each cavity comprises a circular channel with a cover. The dimensions of the cavities and their spacing is log periodic. The cover has excitation covers and conductors for conducting signals received by each of the circular cavities to be input to a novel Butler matrix arrangement which measures phase difference of the received signals. Under ideal conditions there is a one-to-one correspondence between the true angle of arrival and the measured phase differences. The novel Butler matrix arrangement can also determine the phase difference between the plus and minus modes conventionally determined by a Butler matrix, and the last mention phase difference exhibits a phase rate that is twice the AOA rate.

DESCRIPTION OF THE DRAWINGS

The invention will be better understood upon reading the following Detailed Description in conjunction with the drawing in which.

DETAILED DESCRIPTION

Figure 1:
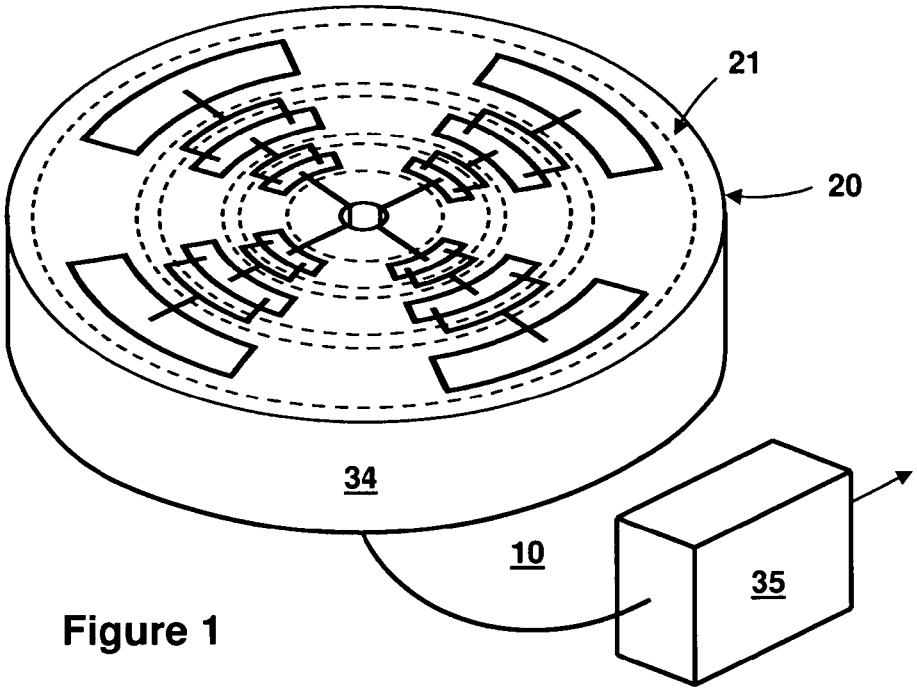
FIG. 1 is a perspective view of the novel log periodic direction finding slot antenna without its fiberglass cover, and with a novel Butler matrix attached.

In the following detailed description the novel concentric ring, log-periodic direction finding slot antenna 10 is described as a receiving antenna that can be used in both a direction finding and geo-location system where the antenna 10 is mounted flush with the surface of an aircraft. However, those skilled in the art know from the reciprocity theorem that the performance of an antenna is the same whether it is used in reception or transmission, provided however, that no non-reciprocal devices (such as diodes) are present. Thus, the novel log-periodic direction finding slot antenna 10 described herein can also be used for transmission applications, although that is not described herein.

Very generally, three types of direction finding (DF) are contemplated. The first type is a fast but fairly accurate DF system utilizing one antenna 10, its Butler matrix 35 and two receivers. The second type is a more accurate CIDF system utilizing all four Mode outputs of one Butler matrix 35 and four receivers, with one receiver being connected to receive one of the four mode outputs of the matrix. The third type is a very accurate CIGL geo-location system utilizing four spaced antennas 10 each having a Butler matrix 35 and a different receiver is connected to receive one of the Mode signals output from each of the four Butler matrixes.

The novel concentric ring log-periodic direction finding slot antenna 10 and its Butler matrix 35, both described herein in detail, are used in single or multi-receiver (none of the receivers is shown), multi-antenna systems, as briefly described in the previous paragraph, to provide accurate DF or geo-location information for signals received using the antennas.

The novel concentric, circular ring, log-periodic direction finding slot antenna 10 described herein is primarily designed to work with vertically polarized waves while providing accurate direction finding information, as previously described, for signals received from within an elevation of about fifteen degrees of the horizon. This typically has not been possible in the prior art when DF antennas are mounted flush within a horizontal surface.

Briefly, novel antenna 10 comprises three basic elements that are shown throughout the Figures. The first element is a base 34 having therein annular concentric, circular slots 11, 12 and 13 shown in and described in detail with reference to FIGS. 2A and 2B. Base 34 may be fabricated from a solid piece of conductive material such as copper or aluminum. Alternatively, it may be formed of conductive metal such as gold, copper or aluminum layered on an insulating substrate.

Figures 3, 7:
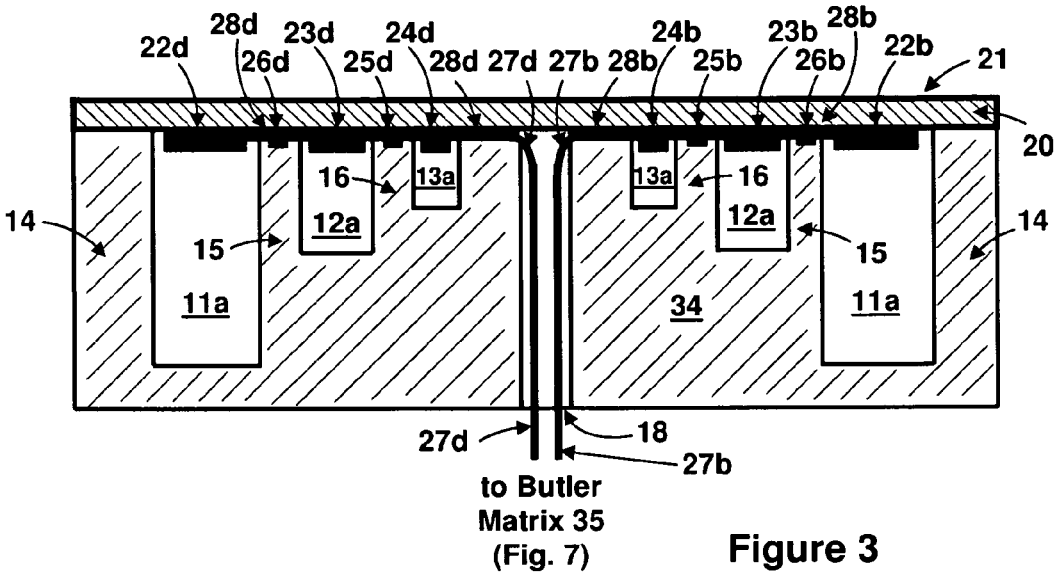
FIG. 3 is a side cutaway view of the novel log-periodic direction finding slot antenna with a top cover covering the circular slots in the base to form the cavities, and on the bottom surface of the top cover are formed slot excitation plates and conductors for the cavities.
FIG. 7 is an equation used in a CIDF process that utilizes modes output from the Butler matrix that are radio frequency voltages utilized by other equipment to provide highly accurate direction finding information.

The second element is a top cover 20 which is a dielectric material shown in and described with reference to FIGS. 3, 4, 5, and 6. Cover 20 preferably comprises a Fiberglass sheet on the bottom surface of which is a layer of copper or other conductive material. Using printed circuit manufacturing techniques copper on the bottom surface of cover 20 is etched away to form transmission line segments 25(*a-d*) and 26(*a-d*), conductive paths 28(*a-d*) and slot excitation plates 22(*a-d*) through 24(*a-d*) as shown in and described with reference to FIGS. 3, 4 and 5. The conductive paths and transmission line segments interconnect slot excitation plates and carry received signals from the three cavities 11*a*, 12*a* and 13*a* of antenna 10 to Butler matrix 35. The slot excitation plates are in the form of circular arcs to efficiently utilize the available space, and are positioned over the slots. The cover 20 with slot excitation plates, transmission line segments, and conductors formed on the bottom side thereof is mounted on top of base 34 as shown in FIG. 3 to form three slot antenna slots 11*a*, 12*a* and 13*a* of log-periodic slot antenna 10. In alternative embodiments of the invention an antenna 10 may have fewer or greater than three cavities.

The third element is a Butler matrix 35 that is shown in and described with reference to FIG. 7. This matrix is mounted external to the assembly of the elements that make up the basic structure of antenna 10. However, the Butler matrix 35 and other circuitry may be mounted in unused space within base 34.

In FIG. 1 is shown a perspective view of antenna 10 connected to an external Butler matrix 35. As shown, antenna 10 is cylindrical in shape and will be set within a cavity in the surface of an aircraft or other vehicle (not shown) so that the upper surface 21 of antenna 10 is flush with the surface of the aircraft or other vehicle on which it is mounted, and the Butler matrix 35 and associated receiver will be internal and below the surface of the aircraft. Antenna top cover 20 is transparent to radio frequency waves and is visually opaque. In FIG. 1 top cover 20 is deliberately shown as transparent so that transmission line segments, conductive paths and slot excitation plates on the bottom surface of top cover 20 may be seen. In addition, the dotted line circles define circular cavities in base 34 of slot antenna 10 below cover 20, and generally showing how the transmission line segments, conductive paths and excitation plates. overlay the cavities.

Signals output from multiple Butler matrices 35 are input to one or more radio receivers, as previously described for the different types of DF and geo-location operation, and other equipment (not shown) that are known in the art, such as, but not limited to, U.S. Pat. No. 7,233,285 cited above. The signals output from Butler matrix 35 are Mode signals 0, +1, −1 and Δ are used to provide direction finding information for DF signal sorting, and they may be used to provide radio frequency voltages to other equipment to provide accurate DF (CIDF) and CIGL transmitter geo-location information.

Figures 2A, 2B:
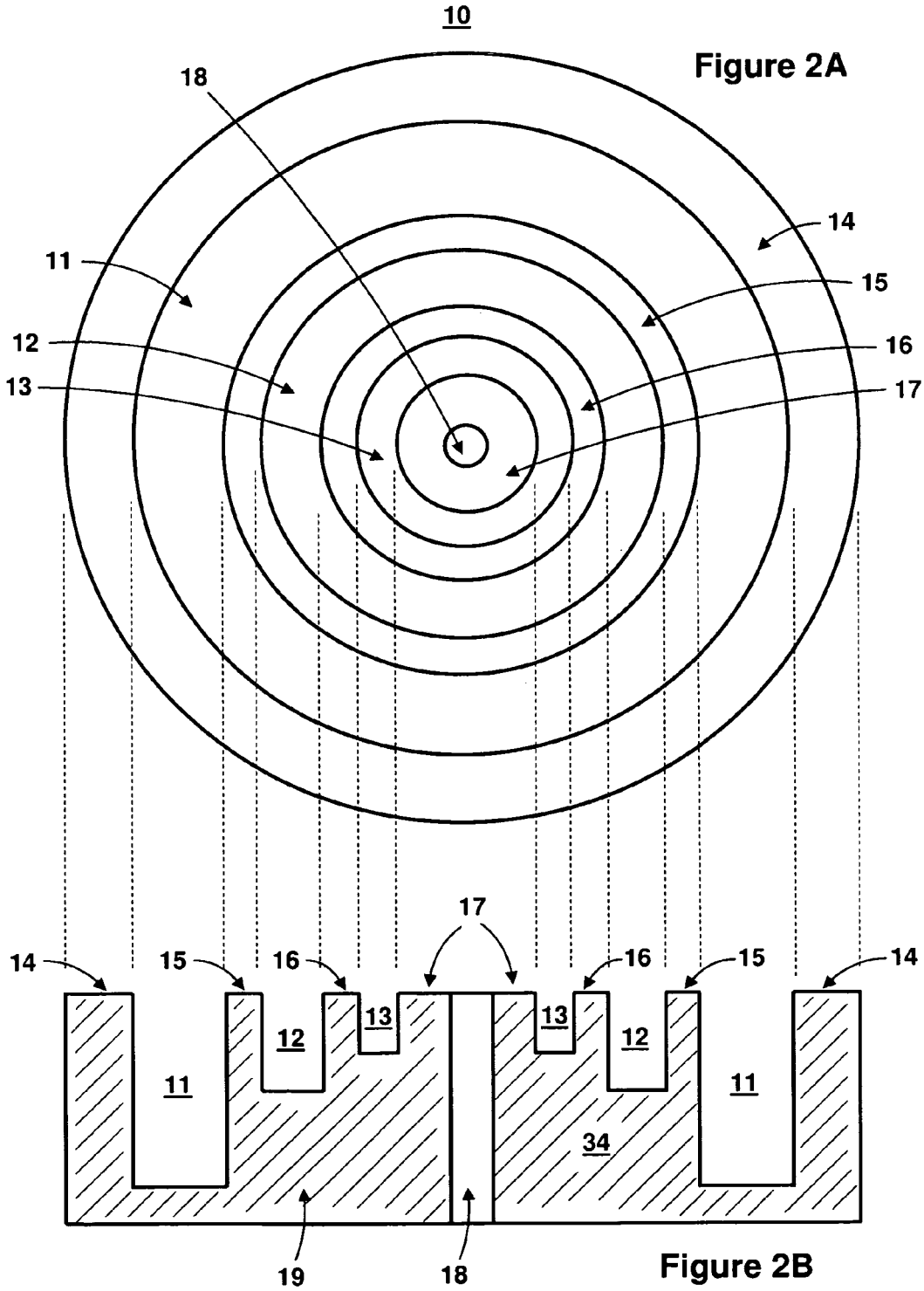
FIG. 2A is a top view of the base of the log periodic direction finding slot antenna showing a plurality of circular slots that are part of the antenna cavities and are dimensioned and spaced on a log-periodic basis.
FIG. 2B is a side cutaway view of the base of the novel log-periodic direction finding slot antenna showing the cross sectional shape of the plurality of circular slots.

In FIG. 2A is shown a top view of base 34 of novel log periodic direction finding slot antenna 10 showing three circular slots 11, 12 and 13 that are part of three slot cavities 11*a*, 12*a* and 13*a* of log periodic direction finding slot antenna 10 formed when cover 20 is mounted on top of base 34 as shown in FIG. 3. In other embodiments of the invention more or fewer slots may be utilized. As previously mentioned base 34 may be fabricated from a solid piece of conductive material such as copper or aluminum, or may be formed of conductive metal such as gold, copper or aluminum layered on an insulating form substrate. FIG. 2A best shows that the slots 11, 12 and 13 are circular and continuous. There is an outside wall 14 of slot 11 which is also the external wall of base 14. There is a common wall 15 between slots 11 and 12, and a common wall 16 between slots 12 and 13. Walls 14 through 17 are best seen in FIG. 2B. Wall 17 is also the circular center of base 34 through which center hole 18 passes. Hole 18 is best shown in and described with reference to FIG. 3. Slots 11, 12 and 13 have different widths, depths and spacing as best seen in FIGS. 2B and 3, and as required for logarithmic spacing and shape of slot antenna cavities 11*a*, 12*a* and 13*a*.

In antenna 10 the smallest circular slot 13 is used for antenna cavity 13*a* which is used to receive signals within a band having the shortest wavelengths, the intermediate sized circular slot 12 is used for cavity 12*a* which is used to receive signals within a band having intermediate wavelengths, and the largest circular slot 11 is used for cavity 11*a* which is used to receive signals within a band having the longest wavelengths. These bands are generally contiguous, but need not be. Only three circular slots 11, 12 and 13 are shown and described herein for the sake of simplicity. The drawing would be too crowded to adequately show the details of more than three slot antenna cavities 11*a*, 12*a* and 13*a*. However, in actual operation there may be more than three circular cavities, especially when signals over a wider range of frequencies are to be received.

Extending through the center 17 of base 34 is a hole 18 through which coaxial cables or transmission lines 27*a-d* pass as shown in and described hereinafter with reference to FIGS. 3, 4 and 5. These wires or cables pass signals received by the cavities 11*a*, 12*a* and 13*a* to Butler matrix 35 shown in FIGS. 1, 3, 4 and 5.

FIG. 2B is a side cutaway view of base 34 of log-periodic slot antenna 10 better showing the cross sectional shape and sizes of the circular slots 11, 12 and 13, and showing the walls 14-17 between them that form the sides of the circular slots. FIG. 2A is better understood when viewed in conjunction with FIG. 2B because the dashed lines between the two figures help understand where circular slots are in FIG. 1A. Circular slots 11, 12 and 13 have different widths and depths as required for log-periodic operation as is well known in the art. The geometry of the slots 11, 12 and 13, and the cavities formed there from, is called log-periodic because the cavities occur, not at every point where the distance from the center of the array at hole 18 has increased by the log-periodic ratio over the distance from the last slot, but at every point where the logarithm of the distance from the center of the array has increased by this ratio. The center of base 34 of antenna 10 is hole 18. The dimensions throughout antenna 10 are proportional to the distance from the center of the array. Not only the dimensions of the slots, but also their separations from each other, are fabricated with respect to the log periodic ratio. Therefore, any two adjacent slots have dimensions that bear the same ratio to each other as do the dimensions of any other two adjacent slots. More particularly, in the graphs shown in FIGS. 8 through 12 the patterns were computed using WIPL-D code at a frequency where outer slot 11 had a diameter equal to ½λ and had depth of ¼λ, and all patterns were computed for vertical polarization DF. The diameter, width and depth of other slots may then be calculated in a manner well known in the art. The log periodic tau τ ratio used to generate these patterns was equal to 1.5. WIPL-D code is a high frequency modeling and simulation software tool available from the WIPL-D corporation.

Briefly, FIG. 3 shows a side cutaway view of base 34 of novel log-periodic direction finding slot antenna 10 showing a circular, dielectric top cover 20 that is preferably a Fiberglass sheet on the bottom surface of which is a layer of copper or other conductive material. After etching some of the conductive material from the bottom surface to form transmission line segments 25 and 26, conductive paths 28, and slot excitation plates 22, 23 and 24, cover 20 is attached to the top surface of base 34 as shown. The transmission line segments, conductive paths and slot excitation plates on the bottom surface of cover 20 carry signals received using the circular cavities 11*a*, 12*a* and 13*a* to an external Butler matrix 35 that is not shown in this Figure.

More particularly, on the bottom surface 21 of cover 20 are formed transmission line segments 25(*a-d*) and 26(*a-d*); slot excitation plates 22(*a-d*), 23(*a-d*) and 24(*a-d*) and a plurality of microstrip or stripline conductors 28(*a-d*) which interconnect the excitation plates as better shown in and described with reference to FIGS. 4 and 5. As mentioned above these transmission line segments, excitation plates and conductors are formed by removing some of the copper on the bottom surface using printed circuit manufacturing techniques. The slot excitation plates and interconnecting conductors in each ninety degree quadrant (LP-1 through LP-4 in FIGS. 4 & 5) conduct signals received by slot antenna cavities 11*a*, 12*a* and 13*a* via four transmission lines 27(*a-d*) to a novel Butler matrix 35 mounted external to base 34, as shown in FIG. 1. There is one of transmission lines 27(*a-d*) from the excitation plates for each ninety degree quadrant. Only two quadrants LP-3 and LP-4 (lead sets b & d) are shown in the side cutaway view of FIG. 3. The four transmission lines 27(*a-d*) are connected to a novel Butler matrix 35 mounted external to base 34, as shown in FIG. 1. Transmission lines 27(*a-d*) are preferably co-axial cable to minimize any capacitive coupling between them as they pass through hole 18 and on to Butler matrix 35. The slot excitation plates all lie over the cavities 11*a*, 12*a* and 13*a* as shown, and are spaced ninety degrees apart as best shown in FIGS. 4 and 5. The Butler matrix 35 is best shown in and described with reference to FIG. 7.

Figure 4:
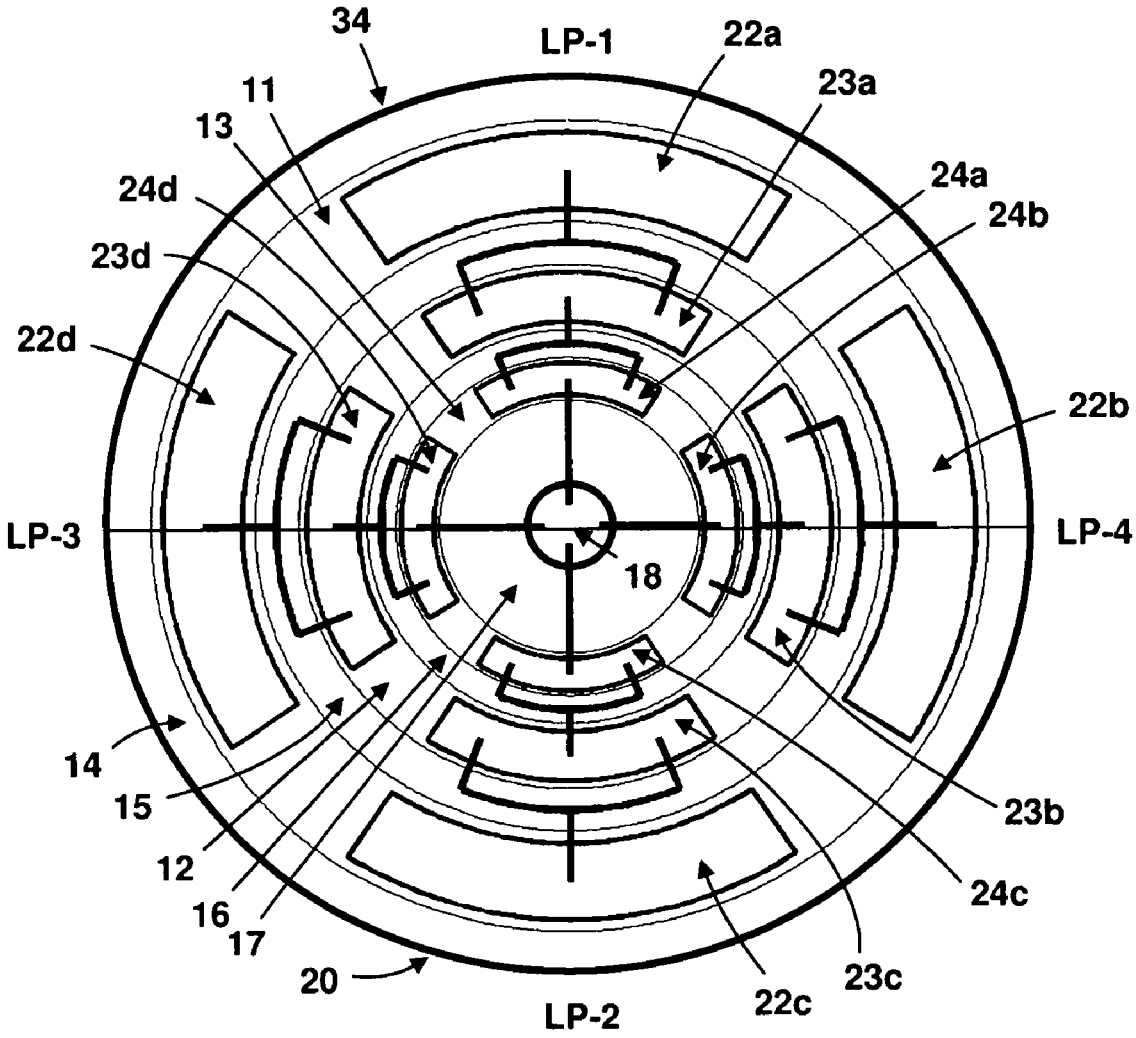
FIG. 4 is a perpendicular view of the bottom surface of the top cover showing a plurality of slot excitation covers thereon that lie over the circular cavities, and are spaced every ninety degrees and cooperate with the cavities to receive radio frequency signals that are conducted to the Butler matrix.
Figure 5:
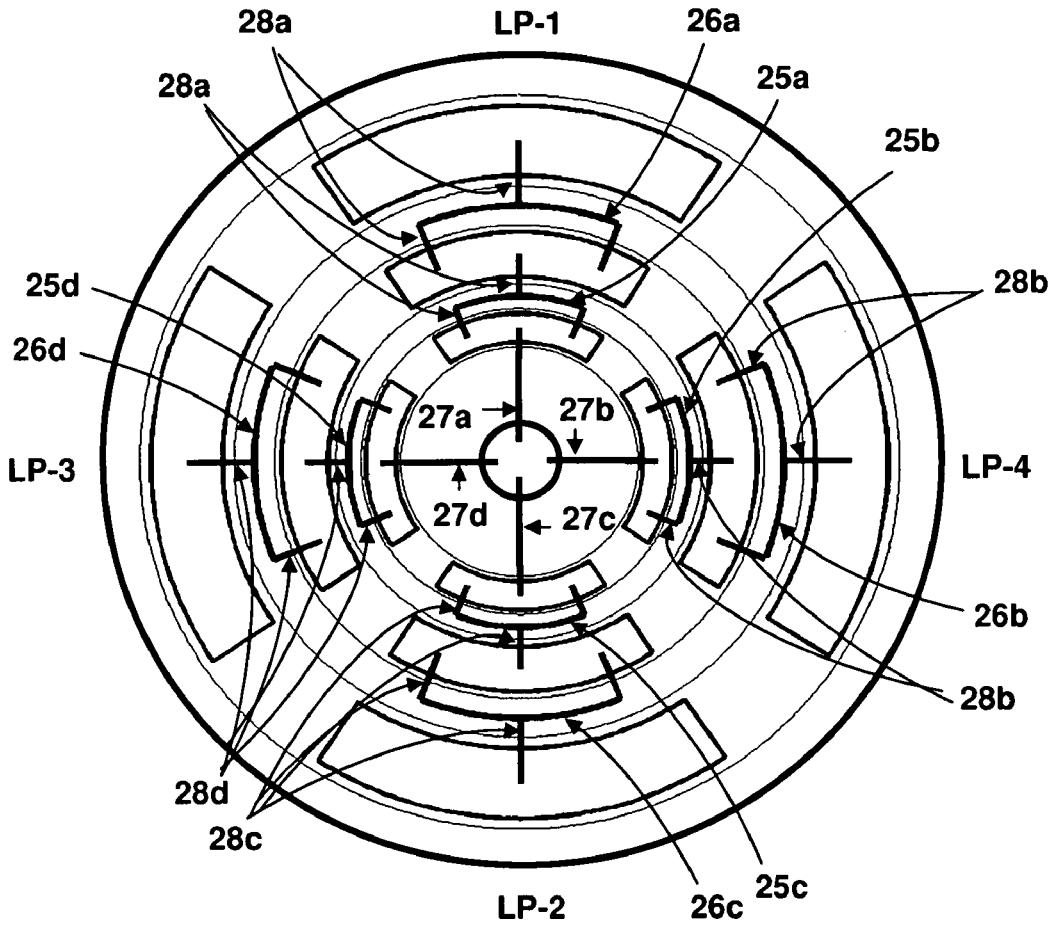
FIG. 5 is the same as FIG. 4 and shows transmission line segments and electrical conductors interconnecting the slot excitation covers positioned over the plurality of circular cavities and the transmission line segments and electrical conductors conduct received signals to the Butler matrix.

FIGS. 4 and 5 are identical and show a perpendicular view of the bottom surface of top cover 20. FIG. 4 identifies just the slot excitation plates 22(*a-d*), 23(*a-d*) and 24(*a-d*) formed on the bottom surface of top cover 20. FIG. 5 identifies just the transmission line segments 25(*a-d*) and 26(*a-d*), and multiple microstrip or stripline conductors 28(*a-d*) that interconnect the slot excitation plates in each of the four quadrants LP-1 through LP-4. As shown in FIGS. 4 and 5 the four quadrants are identical and are spaced ninety degrees apart.

As shown in FIG. 4 four excitation plates lie over each of slots 11, 12 and 13 in base 34. Excitation plates 22(*a-d*) lie over slot 11 and are spaced ninety degrees apart, excitation plates 23(*a-d*) lie over slot 12 and are spaced ninety degrees apart, and excitation plates 24(*a-d*) lie over slot 13 and the excitation plates over each slot are spaced ninety degrees apart. The conductors and transmission lines 25(*a-d*), 26(*a-d*), 27(*a-d*) and 28 (*a-d*) that interconnect the slot excitation plates 22(*a-d*), 23(*a-d*) and 24(*a-d*) and conduct received signals to Butler matrix 35 are shown in both FIGS. 4 and 5 but are identified in and described only with reference to FIG. 5.

As shown in FIG. 5, in each of the four quadrants LP-1 through LP-4 the particular four slot excitation plates of plates 22(*a-d*), 23(*a-d*) and 24(*a-d*) that lie over each of slots 11, 12 and 13 in base 34 are connected by a plurality of conductors and transmission lines that are identified in this figure. These conductors and transmission lines are formed from the conductive layer on the bottom surface of top cover 20 using printed circuit manufacturing techniques. Transmission lines 25(*a-d*) and 26(*a-d*) may alternatively be short pieces of co-axial cable with center taps for connection of conductors 28, or be microstrip transmission line segments with center taps. For quadrant LP-1 there are transmission line segments 25*a*, 26*a* and a plurality of conductors 28*a*. For quadrant LP-2 there are transmission line segments 25*c*, 26*c* and a plurality of conductors 28*c*. For quadrant LP-3 there are transmission line segments 25*d*, 26*d* and a plurality of conductors 28*d*. For quadrant LP-4 there are transmission line segments 25*b*, 26*b* and a plurality of conductors 28*b*. The spacing of the taps on transmission line segments 25(*a-d*) and 26(*a-d*) and the length of the conductors interconnecting them are chosen to establish the conventional log-periodic antenna backward propagation wave as described in Rumsey R. H., "Frequency Independent Antennas," Academic Press, New York 1966, pages 102-105.

The conductors and transmission line segments (hereinafter only referred to as conductors) identified in the previous paragraph for each of quadrants LP-1 through LP-4 conduct received radio frequency signals via four coaxial cables 27(*a-d*) to a novel Butler matrix 35 mounted external to base 34, as shown in FIG. 1. There is one of coaxial cables 27(*a-d*) from the slot excitation plates in each of the ninety degree spaced quadrants LP-1 through LP-4. Coaxial cable 27*a* is connected to slot excitation plate 24*a* in quadrant LP-1, coaxial cable 27*b* is connected to slot excitation plate 24*b* in quadrant LP-4, coaxial cable 27*c* is connected to slot excitation plate 24*c* in quadrant LP-2, and coaxial cable 27*d* is connected to slot excitation plate 24*d* in quadrant LP-3. The four coaxial cables 27*a* through 27*d* pass through hole 18 in the center of base 34 as represented in FIG. 5, but as best seen in FIG. 3. Stated another way, excitation plates 22*a*, 23*a* and 24*a* in quadrant LP-1 are connected to coaxial cable 27*a*; plates 22*b*, 23*b* and 24*b* are connected to coaxial cable 27*b*; plates 22*c*, 23*c* and 24*c* are connected to coaxial cable 27*c*; and plates 22*d*, 23*d* and 24*d* are connected to coaxial cable 27*d*.

The four coaxial cables 27(*a-d*) are connected to different ones of hybrid circuits 36 through 39 of Butler matrix 35 as best seen in FIG. 7. While FIG. 1 shows Butler matrix external to base 34, Butler matrix 35 and other electronics (not shown) may alternatively be mounted inside base 34.

Figure 6:
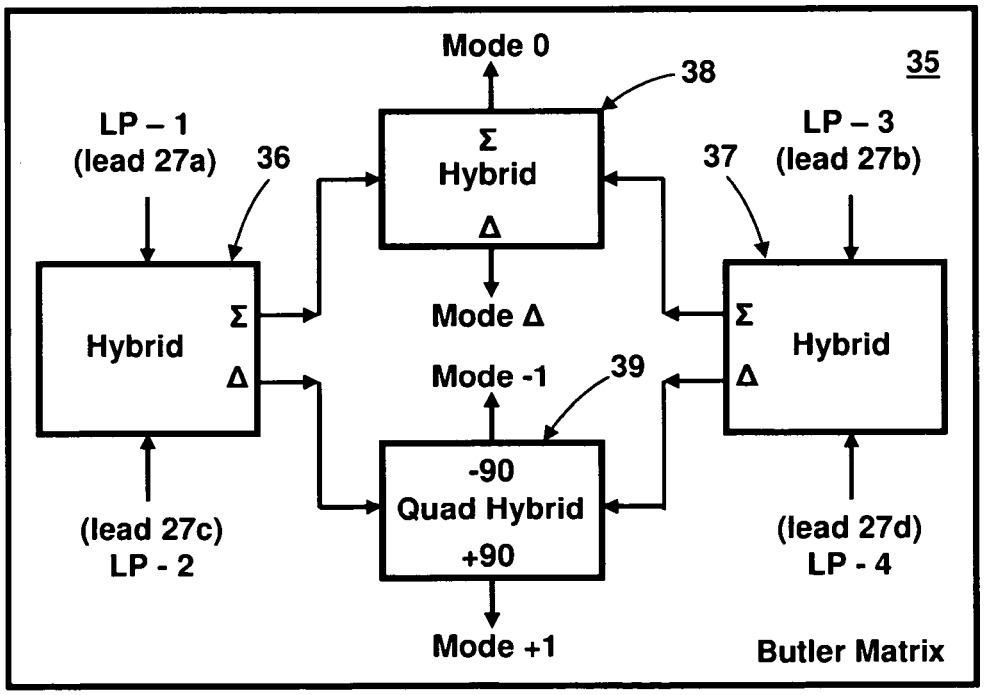
FIG. 6 is a block diagram showing a novel Butler matrix used to combine signals received using the cavities of the log periodic direction finding slot antenna and generate modes that are radio frequency voltages providing direction finding information for DF signal sorting.

In FIG. 6 is shown a schematic block diagram of the novel Butler matrix 35 that receives radio frequency signals received by antenna 10 and carried via coaxial cables 27(*a-d*) that exit base 34 of antenna 10 via hole 18. Butler matrix 35 comprises four hybrid circuits 36 through 39 that are interconnected as shown. Coaxial cables 27*a* and 27*c* are connected to the inputs of hybrid circuit 36, and coaxial cables 27*b* and 27*d* are connected to the inputs of hybrid circuit 37. Thus, received signals from opposite quadrants of all three slot antenna cavities 11*a*, 12*a* and 13*a* are input to each of hybrid circuits 36 and 37. In a known manner hybrid circuits 36, 37 and 38 create the sum and difference of the two signals input to each of them. For each hybrid circuit 36, 37 and 38 the sum of the two input signals is output at its E output and the difference between the two input signals is output at its Δ output. Quad hybrid circuit 39 processes the two signals input to it and the processing result is shifted by +90 degrees for one of its outputs and by −90 degrees for the other of its outputs.

The Σ output from both hybrid circuits 36 and 37 is input to a third hybrid circuit 38, and the Δ output from both hybrid circuits 36 and 37 is input to a fourth (quad) hybrid circuit 39. Output from hybrid circuit 38 is the sum of the two signals input thereto as Mode 0 at its Σ output, and the difference of the two signals input thereto as Mode Δ at its Δ output. Similarly, output from hybrid circuit 39 is the processed result of the two signals input thereto and shifted by +90 degrees to be Mode +1 at its +90° output, and the processed result is shifted by −90 degrees to be Mode −1 at its −90° output.

More simply stated signals received by the circular cavities 11*a*, *d*13*a* are combined and input to the novel Butler matrix 35 which measures phase differences of the received signals. Under ideal conditions there is a one-to-one correspondence between the true angle of arrival and the measured phase differences. The novel Butler matrix 35 can also determine the phase difference between the plus and minus modes (Mode +1 and Mode −1) conventionally determined by a Butler matrix, and the new phase difference exhibits a phase rate that is twice the Angle of Arrival (AOA) rate. In this latter case a 180 degree ambiguity factor must be resolved, generally by (0 to +) or (0 to −) measurements which are obtained from the novel Butler matrix arrangement.

The four signals output from hybrid circuits 38 and 39 (Mode +1, Mode −1, Mode 0 and Mode Δ) of a Butler matrix 35 are voltages for radio frequency signals received using novel slot antenna 10 and novel Butler matrix 35. The voltages from two or four of the Butler matrices 35 are used in one of the three previously mentioned DF, CIDF or CIGL (geolocation) processes to obtain accurate DF or geo-location information.

Figure 8:
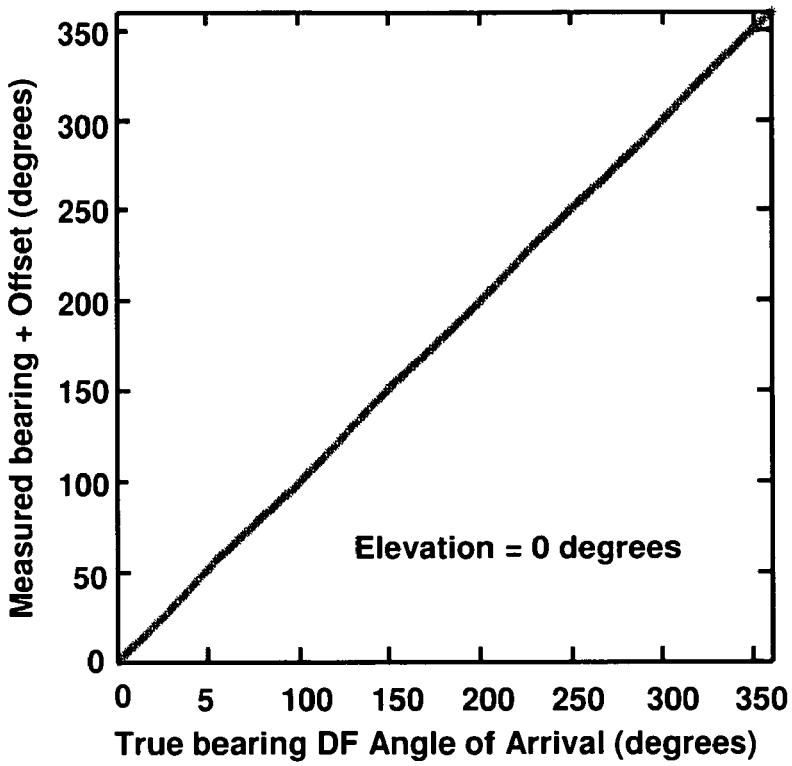
FIG. 8 is a graph showing the accuracy of the direction finding by comparing the measured and actual Angles Of Arrival.

In the simple, fast and relatively accurate DF system there are two receivers with one antenna 10 and its Butler matrix 34. The Mode 0 signal from the Butler matrix 35 is connected to the first receiver and the Mode +1 signal from Butler matrix 35 is connected to the second receiver. The phase difference, as measured between the output of the two receivers, provides DF information as an azimuth bearing to a transmitter. The mode signals from the two matrices 35 are processed to measure the phase difference between these two mode signals, providing for very fast computations of the DF Angle Of Arrival (AOA) to a transmitter that is transmitting. The coarse Butler Mode provides DF vectors having an RMS accuracy of about two degrees. FIG. 8 shows the conversion of the measured phase into DF AOA values. FIG. 8 shows an almost perfect linear response. In practice small hardware component induced errors will induce a departure from this linear phase. These small errors are repeatable and correctable by simple conventional DF calibration tables.

For highly accurate DF information a Correlation Interferometer Direction Finding (CIDF) process is utilized. Four receivers are utilized, each with an antenna 10 and a Butler matrix 34 connected thereto. The Mode 0 signal from the first Butler matrix 35 is input to the first receiver. The Mode +1 signal from the second Butler matrix 35 is input to the second receiver. The Mode −1 signal from the third Butler matrix 35 is input to the third receiver. The Mode Δ signal from the fourth Butler matrix 35 is input to the fourth receiver. The signals output from the four receivers are processed utilizing the CIDF equation shown in FIG. 7. Very accurate DF information to a transmitting transmitter is the result. CIDF solutions are based on the correlation summation of voltages measured at the antennas of a DF antenna array. CIDF calibration tables are used to eliminate errors due imperfect hardware components. CIDF algorithms are discussed in a paper by N. Saucier and K. Struckman, *Direction Finding Using Correlation Techniques*, IEEE Antenna Propagation Society International Symposium, pp. 260-263, June 1975.

The highly accurate geo-location system utilizes four spaced antennas 10, each antenna having its own Butler matrix 35 and a receiver is connected to each Butler matrix. The Mode 0 signal output from each of the four Butler matrixes 35 is input to its corresponding receiver and the outputs from the four receivers are further processed using a Correlation Interferometer Geo-Location (CIGL) algorithm to provide accurate azimuth and elevation information to a transmitting transmitter. Very broadly, CIGL moves correlation processing from the correlation interferometer direction finding CIDF AOA function into the transmitter location function. To implement a geo-location system there is typically an antenna 10 mounted on the underside of each of the wings, the nose and the tail on an aircraft. The CIGL process digitally steers this antenna array by coarse correlating a set of measured array voltages with sets of array testing voltages computed from an assumed testing transmitter location site. The transmission site that establishes the highest correlation value is identified as the transmitter's geo-location. Examples of such Correlation Interferometer Geo-Location (CIGL) operation are taught in U.S. Pat. No. 7,233,285, U.S. Pat. No. 7,268,728 and U.S. Pat. No. 7,453,400.

FIG. 7 is an algorithm used in the aforementioned CIDF process that utilizes the steering voltages (vectors) derived from the four Butler matrix 35 Mode outputs of two antennas and receivers to provide accurate direction finding information to transmitters that are transmitting. These steering voltages are Butler matrix Mode 0, Mode +1, Mode −1 and Mode Δ. CIDF solutions are based on the correlation summation of voltages measured at the antennas of this CRLPSDFA antenna.

The term "na" in the algorithm in FIG. 7 is the number of antennas in the array which, in the example described herein, is four. The term "$U_n$" are the voltages received for signals. The term $\Delta_n(\Phi^t)$ are array calibration voltages for vertically polarized signals. The term $|R(\Phi^t)^2|$ is the square of the correlation information.

Figure 9:
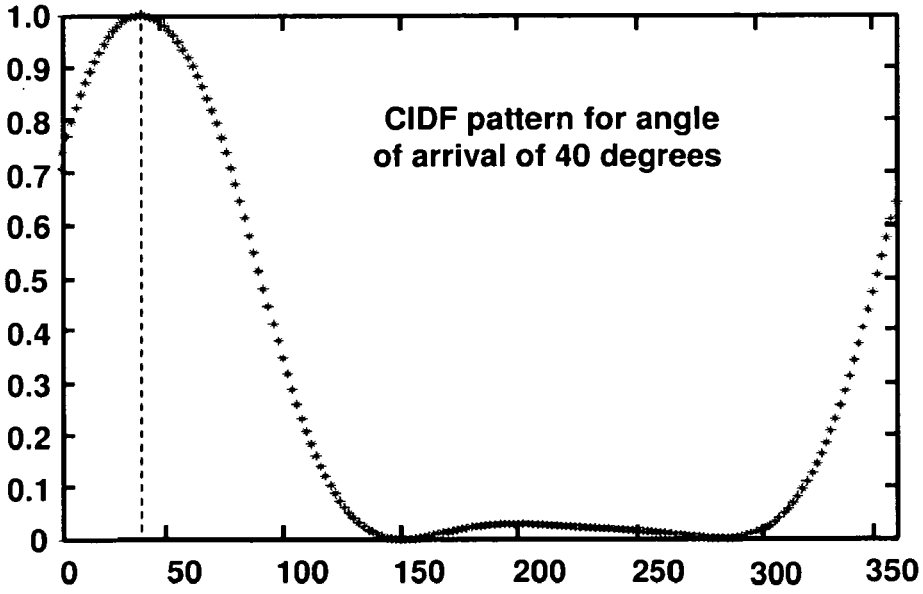
FIG. 9 is a graph showing the correlation between actual and measured angles of arrival of a received signal at one azimuth angle.

FIG. 8 is a graph showing the accuracy of the direction finding Angle Of Arrival using Butler matrix 0 and +90 modes;

FIG. 9 is a graph showing the accuracy of a CIDF system utilizing Modes 0, +1, −1 and Δ signals from Butler matrix 35 and processed using the CIDF algorithm in FIG. 7. Measured correlation versus DF angle testing wave of arrival are shown for a received signal at an elevation of zero degrees and an incident azimuth angle of arrival of 45 degrees. There is almost an identical correlation at the incident angle of 45 degrees.

Figure 10:
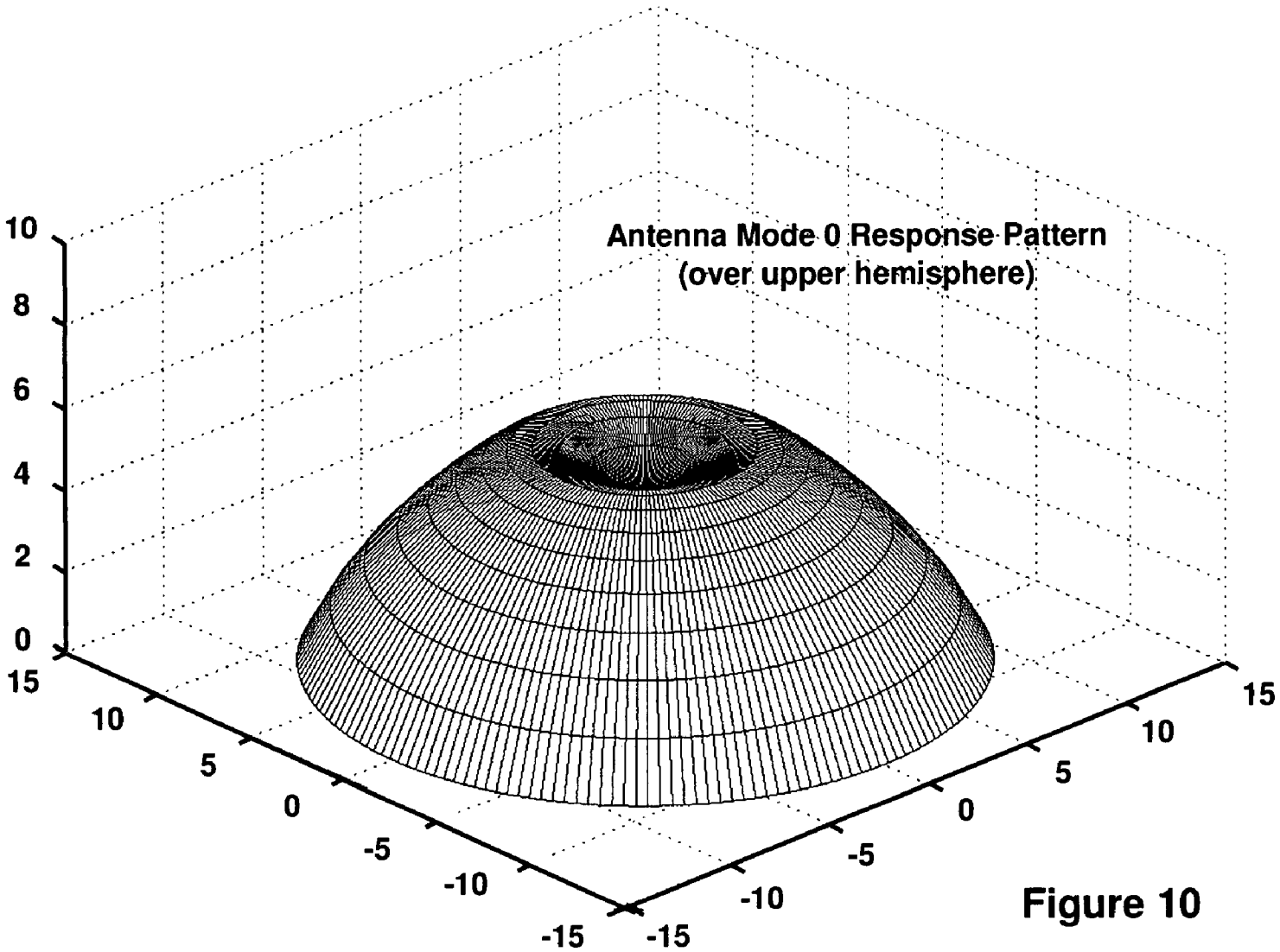
FIG. 10 is an antenna Mode 0 response pattern of the novel log-periodic direction finding slot antenna showing its equal antenna gain in all azimuth directions and at elevations near the horizon.

FIG. 10 shows a Butler matrix mode 0 relative gain pattern of log-periodic direction finding slot antenna 10. The gain pattern is hemi-spherical and shows that there is equal signal receiving coverage over the entire 360 degree azimuthal range at the important elevations near the horizon. There is a null in the zenith direction which is not critical during practical operation. The zenith direction is in the downward direction for typical DF aircraft installations. However, the Mode +1 pattern from Butler matrix 34 for the antenna 10 has a peak in the downward direction which could be ideal for receiving CIGL signals during over flight conditions.

Figure 11:
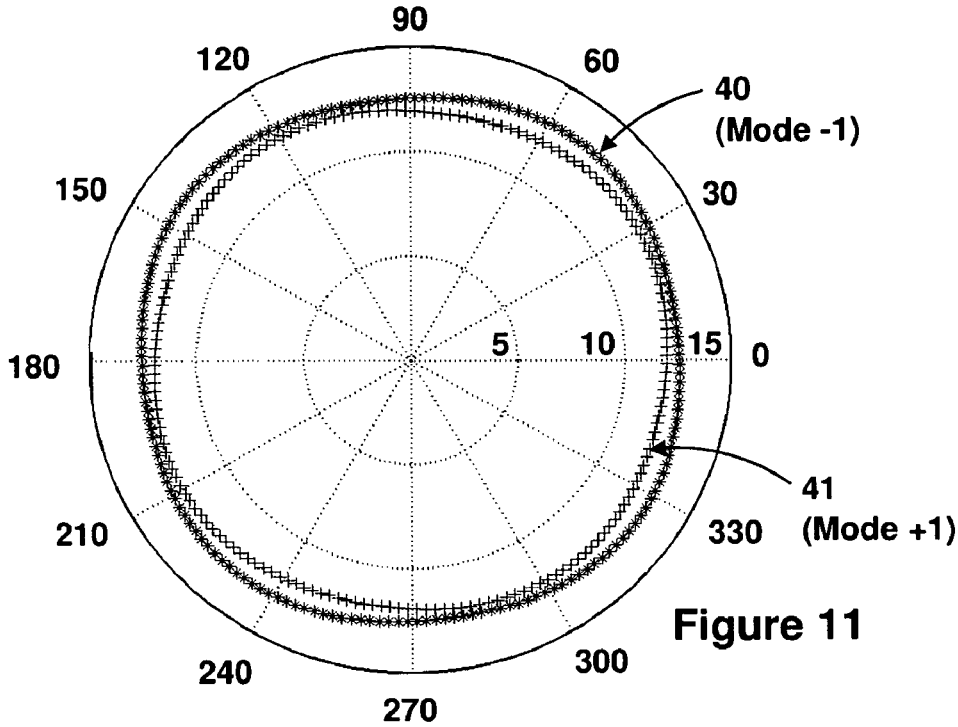
FIG. 11 is a graph showing the relative linear gain of the novel log periodic direction finding slot antenna in all azimuth directions and at an elevation of zero degrees for Butler matrix Modes +1 and −1.

FIG. 11 is a graph of the relative linear gain of antenna 10 with Butler matrix 35 showing generally equal antenna gain in all azimuth directions at an elevation of zero degrees for both Modes +1 and −1. This contributes to the DF and geo-location accuracy of antenna 10 and Butler matrix 35 when direction finding radio frequency signals coming from the horizion.

Figure 12:
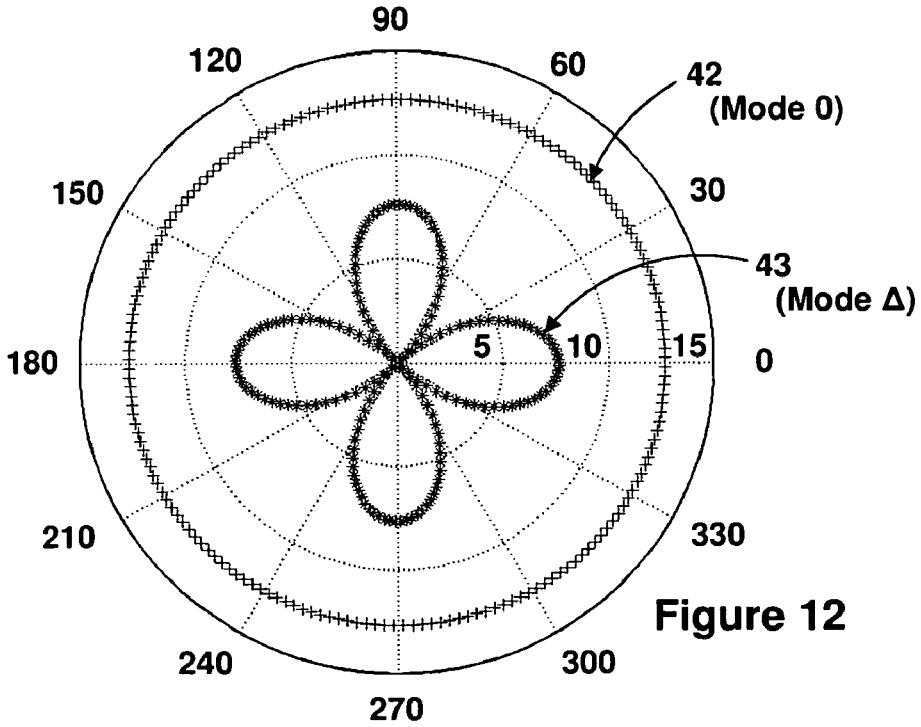
FIG. 12 is a graph showing the relative linear gain of the novel log periodic direction finding slot antenna at all azimuths and at an elevation of zero degrees for Butler matrix Modes 0 and Δ.

FIG. 12 is a graph of the relative linear gain of antenna 10 with Butler matrix 35 showing equal gain in all azimuth directions at an elevation of zero degrees for Modes 0. FIG. 12 also shows the relative linear gain of antenna 10 with Butler matrix 35 at an elevation of zero degrees and at all azimuth directions for Mode Δ.

While what has been described hereinabove is a preferred embodiment of the invention those skilled in the art will understand that numerous changes may be made without departing from the spirit and scope of the invention. The output from the novel log-periodic direction finding slot antenna may be used for other than direction finding purposes, and may also, with the proper complex weighting networks, be used for transmitting directional signals.

The invention claimed is:

1. A log-periodic antenna with an omnidirectional output comprising:

(a) a base having a top surface with a plurality of concentric, continuous slots therein, each slot being separated from adjacent slots by a wall in the base, and a hole through the base with the slots being around the hole;

(b) a dielectric sheet;

(c) a plurality of groups of log-periodic antenna elements on the dielectric sheet; and (d) a conductor connected to each group of antenna elements;

wherein the dielectric sheet with the plurality of groups of log-periodic antenna elements thereon is attached to the top surface of the base and the conductors pass through the hole through the base.

2. The log-periodic antenna of claim 1 wherein each of the groups of log-periodic antenna elements comprises a plurality of excitation plates, with each group of antenna elements having an excitation plate being positioned over each of the plurality of concentric slots.

3. The log-periodic antenna of claim 2 wherein each of the groups of log-periodic antenna elements point in a different direction and the groups of log-periodic antenna elements are equally spaced from each other.

4. The log-periodic antenna of claim 3 wherein the groups of log-periodic antenna elements are all on the bottom surface of the dielectric sheet and the bottom surface of the sheet is adjacent to the top surface of the base when the sheet is attached to the base.

5. The log-periodic antenna of claim 4 wherein the concentric, continuous slots are circular.

6. The log-periodic antenna of claim 5 wherein each of the excitation plates of each group of antenna elements has an arctuate shape having a radius matching the radius of the slot over which they are positioned.

7. The log-periodic antenna of claim 6 wherein each group of antenna elements further comprises a plurality of microstrips, striplines or transmission lines that interconnect the excitation plates of the group.

8. The log-periodic antenna of claim 7 wherein the dimensions and positioning of the microstrips, striplines and transmission lines interconnecting the excitation plates of each group of antenna elements are selected to create a backward wave in each of the groups.

9. The log-periodic antenna of claim 1 wherein the groups of log-periodic antenna elements comprises four groups of antenna elements, each group having a transmission line connected thereto.

10. The log-periodic antenna of claim 9 further comprising a Butler matrix that is made up of:

(a) a first hybrid circuit having a first input to which a first signal from a first of the four transmission lines is connected and a second input to which a second signal from a second of the four transmission lines is connected, having a sum output on which is output a third signal which is the sum of the first and second signals, and having a difference output on which is output a fourth signal which is the difference of the first and second signals;

(b) a second hybrid circuit having a first input to which a fifth signal from a third of the four transmission lines is connected and a second input to which a sixth signal from a fourth of the four transmission lines is connected, having a sum output on which is output a seventh signal which is the sum of the fifth and sixth signals, and having a difference output on which is output an eighth signal which is the difference of the fifth and sixth signals;

(c) a third hybrid circuit having a first input to which the third signal is connected and a second input to which the seventh signal is connected, having a sum output on which is output a ninth signal which is the sum of the third and seventh signals, and having a difference output on which is output a tenth signal which is the difference of the third and seventh signals; and (d) a fourth hybrid circuit having a first input to which the fourth signal is connected and a second input to which the eighth signal is connected, having a first output on which is output an eleventh signal which is the combination of the fourth and eighth signals shifted plus ninety degrees, and having a second output on which is output a twelfth signal which is the combination of the fourth and eighth signals shifted minus ninety degrees;

wherein different ones of the outputs from the four hybrid circuits are used for purposes such as direction finding and signal source geo-location.

11. The log-periodic antenna of claim 1 wherein each group of antenna elements further comprises a plurality of microstrips, striplines or transmission lines that interconnect the excitation plates of the group.

12. The log-periodic antenna of claim 11 wherein the dimensions and positioning of the microstrips, striplines and transmission lines interconnecting the conductive elements of each group of log-periodic antenna elements are selected to create a backward wave in each of the antennas.

13. The log-periodic antenna of claim 12 wherein the concentric, continuous slots are circular.

14. The log-periodic antenna of claim 1 wherein the concentric, continuous slots are circular.

15. The log-periodic antenna of claim 14 wherein the groups of log-periodic antenna elements are all on the bottom surface of the dielectric sheet and the bottom surface of the sheet is adjacent to the top surface of the base when the sheet is attached to the base.

16. The log-periodic antenna of claim 1 wherein signals received by the log-periodic antenna system are vertically polarized.

17. An omnidirectional log-periodic antenna comprising:

(a) a base having a top surface with a plurality of concentric, continuous slots therein, each slot being separated from adjacent slots by a wall in the base, and there is a hole through a central point of the base and the slots are around the hole;

(b) a dielectric sheet that serves as a cover over the slots in the base;

(c) a plurality of log-periodic antenna elements on a surface of the dielectric sheet, the plurality of antenna elements being divided into a plurality of groups of antenna elements, each group of antenna elements being connected together by conductive paths; and (d) a piece of transmission line connected to each group of antenna elements, each piece of transmission line being used to output signals received by the group of antenna elements to which it is connected;

wherein the side of the dielectric sheet with a plurality of groups of antenna elements thereon is attached to the side of the base with the slots therein, and each antenna element in each group of antenna elements is positioned over one of the plurality of slots, and the transmission line connected to each group of antenna elements passes through the hole through the base.

18. The omnidirectional log-periodic antenna of claim 17 wherein the plurality of groups of antenna elements comprise an even number of groups and each of the antenna element groups points in a different azimuth direction and the antenna element groups are all equally spaced from each other.

19. The omnidirectional log-periodic antenna of claim 18 wherein the concentric, continuous slots are circular.

20. The omnidirectional log-periodic antenna of claim 19 wherein the dimensions and positioning of the conductive paths interconnecting the elements of each group of antenna elements are selected to create a backward wave in each of the groups of antenna elements.

* * * * *